United States Patent [19]

Johansson

[11] Patent Number: 4,793,008

[45] **Date of Patent: * Dec. 27, 1988**

[54] METHOD OF TRANSFERRING A PATIENT AND MATS THEREFOR

[76] Inventor: Paul J. Johansson, 1416 Grant Rd., Northbrook, Ill. 60062

[ * ] Notice: The portion of the term of this patent subsequent to Oct. 20, 2004 has been disclaimed.

[21] Appl. No.: 940,727

[22] Filed: Dec. 11, 1986

Related U.S. Application Data

[63] Continuation-in-part of Ser. No. 830,261, Feb. 18, 1986, Pat. No. 4,716,607, and Ser. No. 869,367, Jun. 2, 1986, Pat. No. 4,700,416.

[51] Int. Cl.[4] ..... A61G 7/08

[52] U.S. Cl. ..... 5/81 R; 5/89

[58] Field of Search ..... 5/61, 81 R–81 C, 5/82, 83, 88, 89; 128/87 R

[56] References Cited

U.S. PATENT DOCUMENTS

| | | | |
|---|---|---|---|
| Re. 28,620 | 11/1975 | Jordan et al. | 5/82 R |
| 3,829,914 | 8/1974 | Treat | 5/82 R X |
| 4,012,799 | 3/1977 | Rutherford | 5/81 R |
| 4,033,000 | 7/1977 | Bonifay | 5/82 R |
| 4,067,079 | 1/1978 | Buchman | 5/82 R X |
| 4,283,068 | 8/1981 | Keyser | 5/82 R X |

*Primary Examiner*—Gary L. Smith
*Assistant Examiner*—Michael F. Trettel
*Attorney, Agent, or Firm*—Silverman, Cass, Singer & Winburn, Ltd.

[57] ABSTRACT

A simplified patient transfer mat for aiding the moving of a patient who cannot move oneself. The mat includes an elongated body portion with a substantially rectangular shape adapted to be placed transversely under the patient. The body portion is rigid yet flexible enough to at least partially conform to the contour of a portion of the patient's body. The mat including grasping openings in each end with slots adjacent thereto for securing a strap therethrough to secure the patient to the mat. A pair of mats are placed under the patient forming a transfer method and system to move the patient by sliding or lifting.

14 Claims, 3 Drawing Sheets

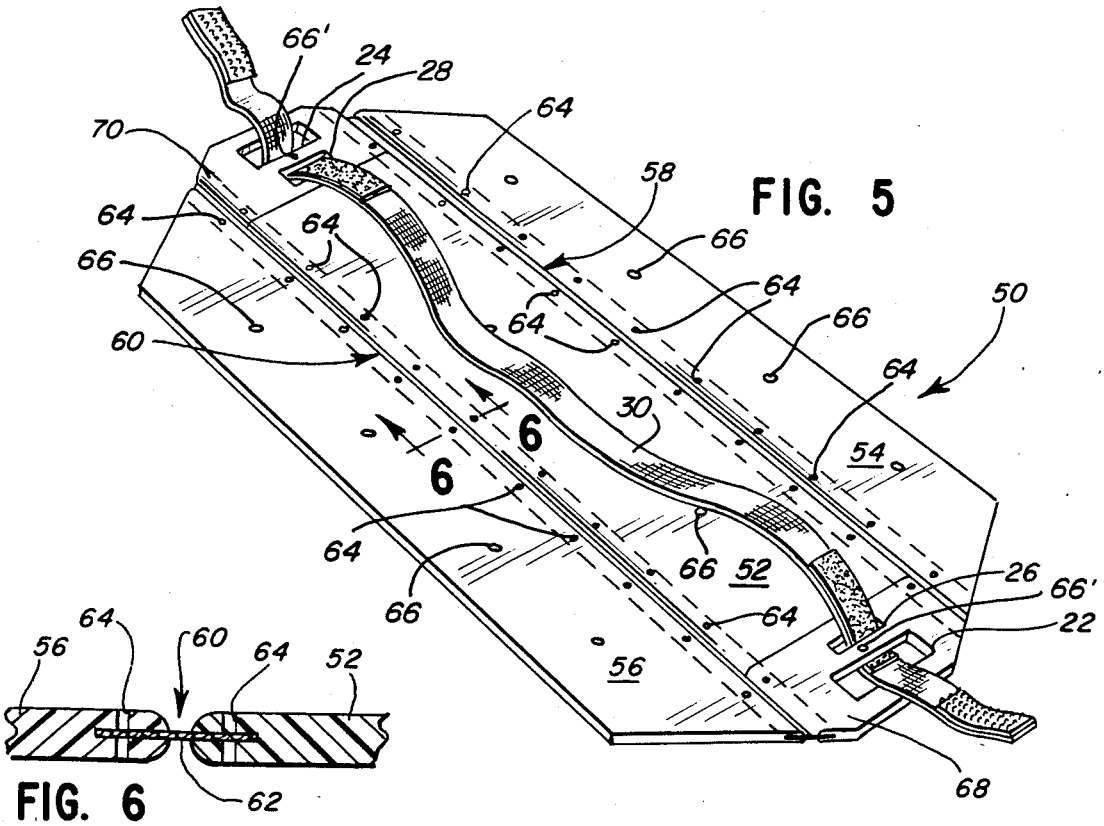
FIG. 5
FIG. 6
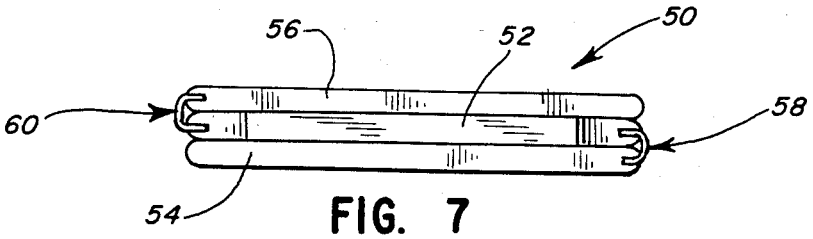
FIG. 7
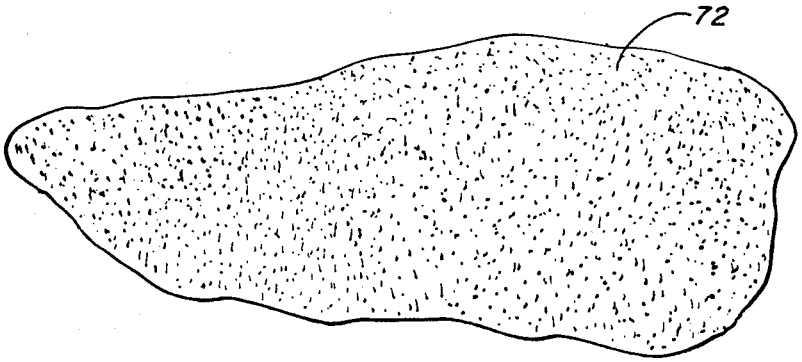
FIG. 8

METHOD OF TRANSFERRING A PATIENT AND MATS THEREFOR

RELATED APPLICATIONS

This application is a continuation-in-part of U.S. Ser. No. 830,261 filed Feb. 18, 1986 now U.S. Pat. No. 4,716,607, and U.S. Ser. No. 869,367 filed June 2, 1986, now U.S. Pat. No. 4,700,416, the disclosures of which are incorporated herein by reference.

BACKGROUND OF THE INVENTION

The invention relates generally to patient moving methods and systems and more particularly to a simplified patient transfer mat which is easy to utilize and can be readily stacked for storage.

Any number of methods and systems have been utilized to shift or move a patient who is unable to move themselves. The patient can be partially lifted, slid or rolled onto a stretcher or bed by several attendants. The patient is again moved onto an operating, examining or x-ray table and then the process is repeated to place the patient back into the patient's bed. Each of these moves has the potential to aggravate the patient's injuries or even to cause new injuries.

Numerous types of systems have been utilized to assist in shifting of a patient while attempting to minimize risk of injury and to facilitate ease of movement. These systems have included boards and other types of stretcher type units, which have been relatively inflexible or very flexible, such as made from sheets, canvas or blankets. One system includes an elongated plastic slab or plank placed longitudinally under the patient. Each of these systems has attempted to provide for ease in placing the patient onto the system. The elongated plastic slab, for example, is about 508 mm by 1016 mm or larger and is made to be longitudinally placed beside the patient. The patient then is turned on edge and placed on the slab by the so-called "log rolling" technique. The slab is of a size such that the patient is substantially totally supported on the slab and can be moved or lifted on the slab by utilizing hand holds or openings in the edge of the slab. Such a slab is inconvenient to store, because of its size and it does not include any means for securing the patient onto the slab.

The simplified patient transfer mat provides certain desirable advantages not obtained with the transfer mat inventions of parent U.S. Ser. Nos. 830,261 and 869,367. These advantages derive from forming each mat from an appropriately sized flexible piece of material. As in parent U.S. Ser. No. 869,367, at least one surface of the mat is striated or textured so that accumulation of static electric charge on that surface is prevented by reason of friction contact with textile material of a bed sheet or clothing of the patient as the mat is slid under a patient. The mat also is very economical to produce since it is less complicated, does not fold and a plurality of the mats easily can be stacked upon one another for storage.

SUMMARY OF THE INVENTION

The above and other disadvantages of prior art transfer methods and systems are overcome in accordance with the present invention by providing a simplified elongated transfer mat which is small, flat, but still flexible. The mat is formed from a substantially rigid material in a single, appropriately sized piece. The mat can include a strap to secure a patient thereto. The method and system includes a pair of mats with one placed transversely under the patient's shoulders and another placed transversely under the patient's buttocks. The straps can be secured across the top of the patient and then a single attendant can slide the patient from a bed onto a transfer table or from table to stretcher. Further, the mats have hand holds in their outer ends which can be grasped by the attendant or can be grasped by an attendant on each side to lift the patient.

BRIEF DESCRIPTION OF THE DRAWINGS

FIG. 5 is a perspective view of a mat of the invention of patent application U.S. Ser. No. 869,367;

FIG. 6 is an enlarged side sectional view of the mat of FIG. 5 taken along the line 6—6 therein;

FIG. 7 is an end view of the folded mat of FIG. 5;

FIG. 8 is an enlarged view of one surface portion of the mat of FIG. 5;

DESCRIPTION OF THE PREFERRED EMBODIMENTS

FIGS. 1-4 are illustrative of embodiments disclosed in parent application, U.S. Ser. No. 830,261.

Figure 1:
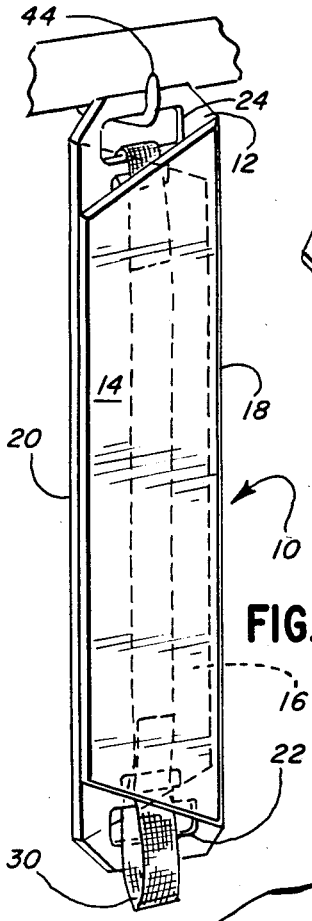
FIG. 1 is a perspective view of a mat of the invention of parent application U.S. Ser. No. 830,261 folded for storage.
Figure 2:
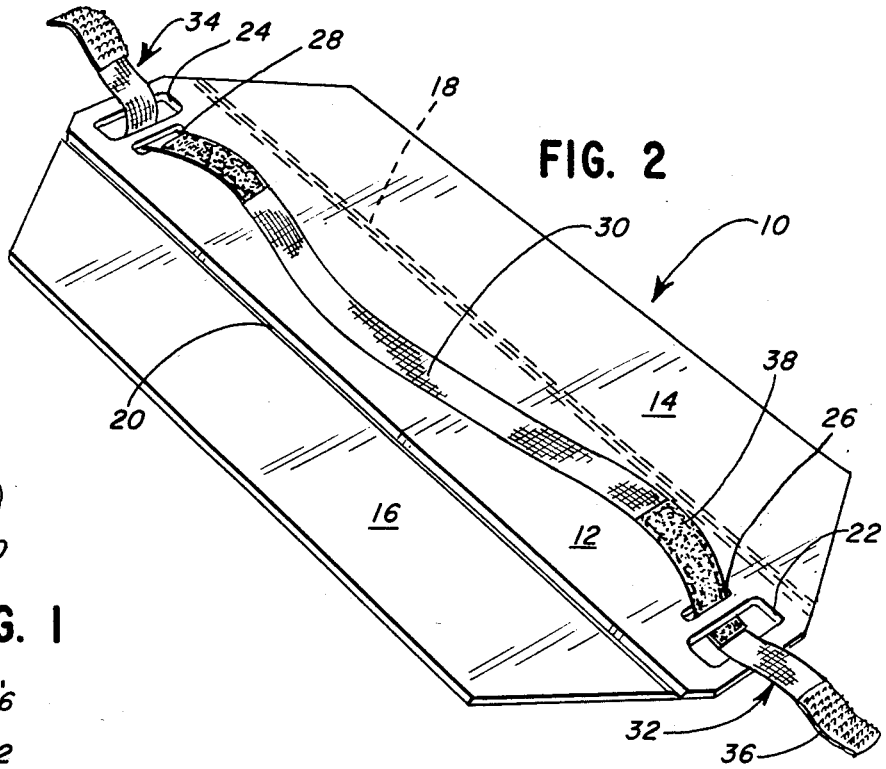
FIG. 2 is a perspective view of the mat of FIG. 1 unfolded for utilization.

Referring to FIGS. 1 and 2, a patient transfer mat embodying the invention of the parent application is designated generally by the reference numeral 10. The mat 10 has an elongated body portion including a center section 12 and a pair of wing sections 14 and 16. The mat 10 preferably is formed in a generally rectangular shape from a plastic material such as polyethylene, with a fairly smooth surface for ease of sliding and positioning of the mats 10 under a patient. The wings 14 and 16 are hingedly connected to the center section 12 along respective hinge regions 18 and 20. The hinge regions 18 and 20 preferably are formed integrally with the wings 14 and 16 and the center section 12, such as by a reduced or thinner thickness of material which allows the wings 14 and 16 to be folded over onto the center section 12.

The ends of the mat 10 include respective openings 22, 24 which can be grasped by an attendant to lift or move the patient. A second smaller opening or slot 26, 28 is included adjacent respective openings 22, 24, which slots 26, 28 and openings 22, 24 accommodate a strap 30 therethrough. The strap 30 includes fastening means 32, 34 at each end thereof, such as a typical loop and hook type of fastener which has a loop area 36 and a hook area 38 which adhere to each other when pressed together.

Figure 3:
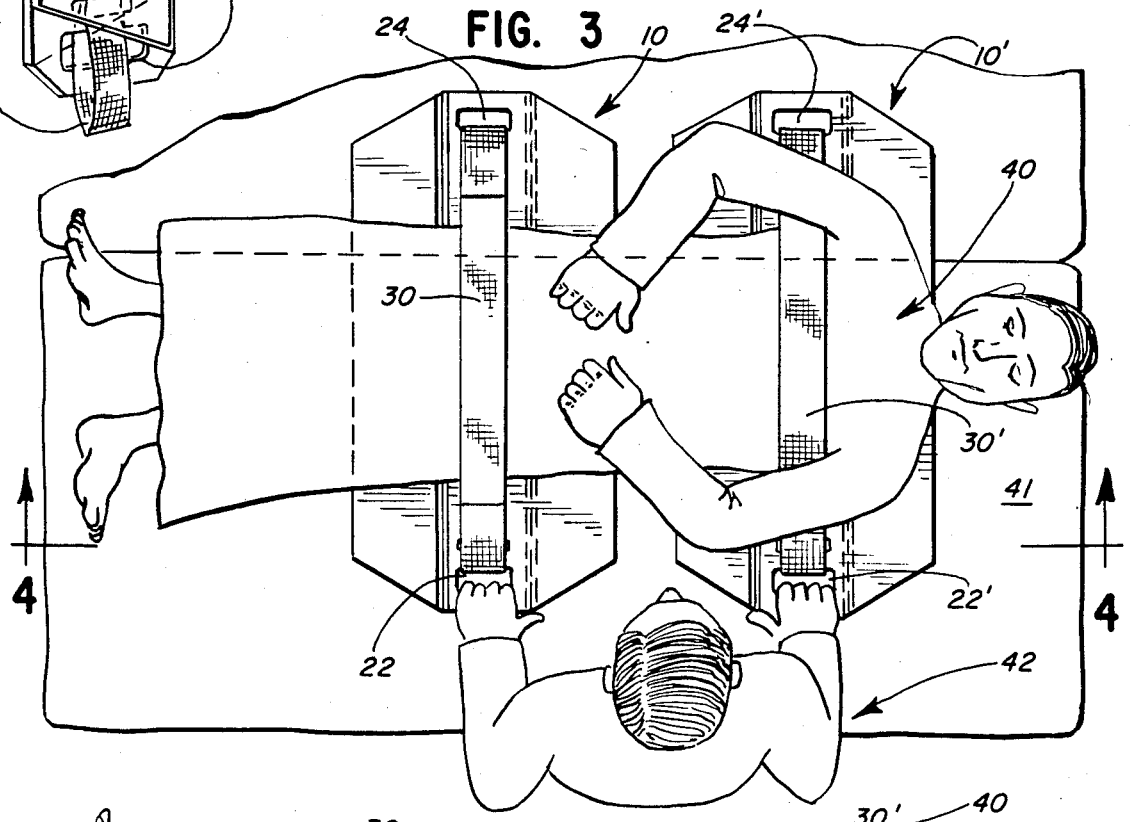
FIG. 3 is a top plan view of a pair of mats of FIG. 1 placed under a patient for movement of the patient.
Figure 4:
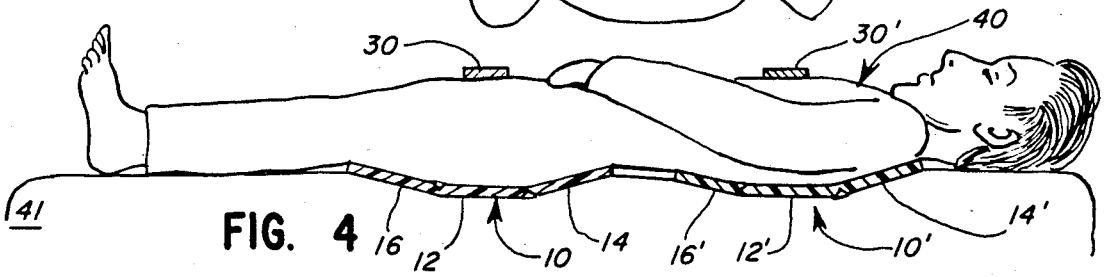
FIG. 4 is a side sectional view of the mats and patient of FIG. 3 taken along the line 4—4 therein.

Referring now to FIGS. 3 and 4, the shifting or moving of a patient 40 onto or out of a bed 41 by an attendant 42 is best illustrated. A pair of mats 10 and 10' is inserted under the patient 40 and then the straps 30, 30' can be fastened over the patient 40 to secure the patient to the mats 10, 10' while the patient is moved. If required, a second attendant (not illustrated) can grasp the pair of mats 10, 10' utilizing the openings 24 and 24', while the attendant 42 grasps the openings 22, 22'. The small/relative surface area of the mats 10, 10' allow them to be easily slid or placed under the patient 40, while still providing the necessary strength to lift the patient 40, if required.

As can be seen in FIG. 4, the mat 10 is placed under the buttocks of the patient 40, while the mat 10' is placed under the upper back of the patient. The respective center and wing sections 12, 14 and 16 and 12', 14' and 16' of the mats 10 and 10' at least partially conform with the contour of the patient's body, when the patient 40 is resting on a surface, such as the bed 41. The folding wing sections 14 and 16 of the mat 10 provide a large and sufficient sliding surface for ease in moving the patient 40, while still allowing the mat 10 to have a small profile for storage. The mats 10, 10' then provide a very easy to use patient moving system, while the mats can be folded for storage, such as on a convenient hook 44 (FIG. 1). The hook 44 or other protuberance can be on a gurney or transfer bed/stretcher or in any other convenient location.

FIGS. 5–8 are illustrative of embodiments disclosed in parent application U.S. Ser. No. 869,367.

Referring to FIG. 5, a transfer mat embodying the invention of the parent application is designated generally by the reference numeral 50. The improvement lies primarily in the hinge mechanism allowing the mat sections easily and repeatedly to be folded upon one another. The improved transfer mat 50 illustrated in FIGS. 5–8 is substantially the same in overall function to the mat 10 illustrated in FIGS. 1–4. All common reference numerals refer to the same parts and the mats 50 can replace the mats 10 in the system illustrated in FIGS. 3 and 4.

The mat 50 has an elongated body portion including a center section 52 and a pair of wing sections 54 and 56. The mat 50 preferably is formed in a generally rectangular shape from a suitable plastic material with at least one smooth surface for ease of sliding and positioning of the mats 50 under the patient 40 (FIG. 3). Preferably, a thermosetting type synthetic plastic polymer or resin which provides a rigid, strong and yet somewhat flexible section is desirable. Also, the section should not shatter or fracture under the weight of the patient. Methacrylate polymers and polystyrene are suitable materials.

The wing sections 54 and 56 are hingedly connected to the center section 52 by respective hinge mechanisms 58 and 60. The hinge mechanisms 58 and 60 are formed by providing a web of woven polyester or the like material, which is flexible but does not stretch to any appreciable extent in either its longitudinal or lateral extent. As best illustrated in FIG. 6, a web 62 is molded into the edges of the sections 52 and 56. The hinge 58 is formed in a like manner between the sections 52 and 54. Each hinge member is selected to have a thickness of between 0.75–1.25 millimeters, however a thickness of about 1 millimeter is preferred. The width of each web is about 2 centimeters.

The web 62 is first placed in a mold (not illustrated) and then a plurality of holding pins are clamped against the web 62 before the material is injected into the mold to form the sections 52, 54 and 56. The pins hold the web 62 in the proper position and leave a plurality of apertures 64 in the molded sections when the completed mat 50 is removed from the mold.

A plurality of indentations 66 also may be left in the completed sections 52, 54 and 56 from the injection points of the mold. The placement of such injection points and hence the indentations 66 generally is not critical, as long as the points are located to allow sufficient material to adequately fill the mold.

The ends of the mat 50 include respective openings 22, 24 which can be grasped by the attendant 42 to lift or move the patient 40. Second smaller openings or slots 26, 28 are included adjacent the respective openings 22 and 24. The slots 26, 28 and the openings 22, 24 accommodate the straps 30 therethrough for utilization as previously described.

To provide additional strength to the mat 50, each end portion 68 and 70 can be formed of a thicker body of material. It is preferable to include injection points in the narrow area between the openings 22, 26 and 24, 28 as evidenced by the indentations 66'. These injection points ensure that sufficient material is injected into all the areas of the end portions 68 and 70.

The more flexible hinge mechanisms 58 and 60 ensure that the mat 50 easily and repeatedly can be folded for storage as illustrated in FIG. 7. The flexible hinges 58 and 60 also ensure that the folded mat 50 will lie flat for more compact storage. Notably, the individual adjacent sections will not move relative one another because of the manner in which the hinge members are anchored between the engaged sections.

One side of the mat 50 preferably is formed to have a textured surface 72 as illustrated in FIG. 8. The textured surface 72 assists in reducing the friction and static electricity accumulation when the mat 50 is slid under the patient 40. The textured surface 72 can be in the form of small bumps or striations or ridges formed in the mold in a random pattern. Preferably, both surfaces of the sections are so formed.

While fabricating the mat, it is contemplated that a lubricant-type ingredient can be mixed with the plastic material fed to the injection mold equipment. Such an ingredient would help facilitate sliding the mat under a body portion of a patient and also, sliding the patient relative to a surface while he is strapped on the mat.

The improvements of the present invention now will be discussed with reference to FIGS. 9 and 10.

Figure 9:
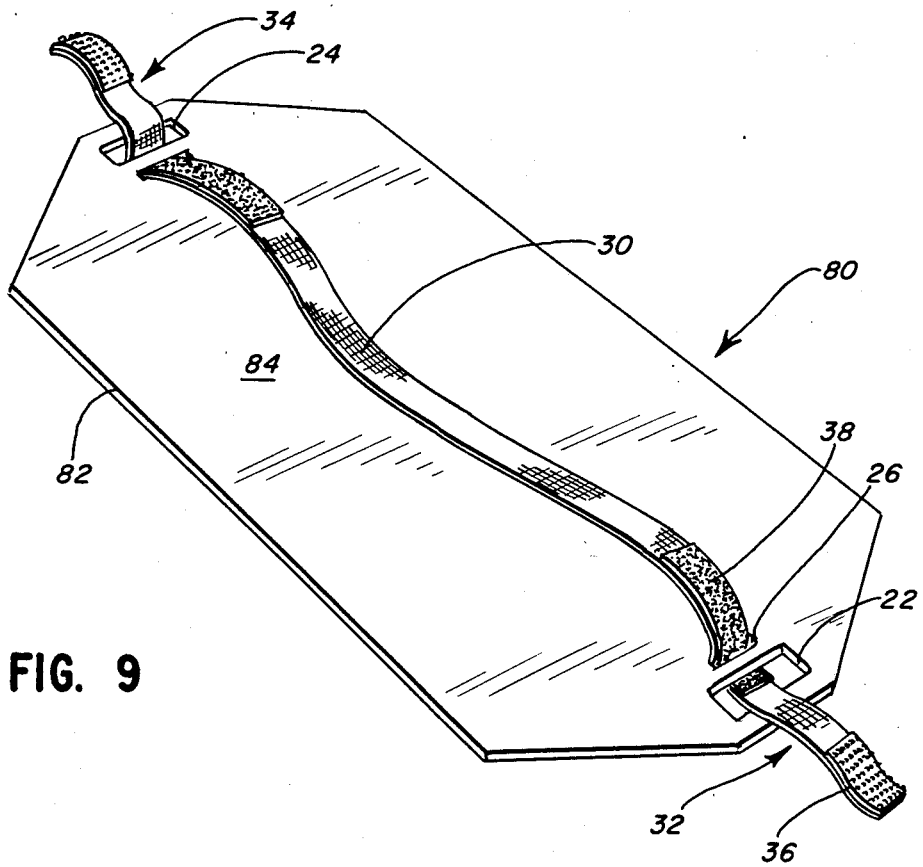
FIG. 9 is a perspective view of one simplified mat of the present invention.

In FIG. 9, a simplified transfer mat embodying the present invention is designated generally by the reference numeral 80. The simplified mat 80 illustrated in FIGS. 9 and 10 is substantially the same in overall function to the mat 10 illustrated in FIGS. 1–4 and the mat 50 illustrated in FIGS. 5–8.

The simplified mat 80 has its most advantageous features in the manufacturing process. The mat 80 is formed without the folds of either the mat 10 or the mat 50. Therefore, the attendent cost in manufacturing and packing of the completed mat 80 can be significantly less than the mats 10 and 50. Further, where lateral space does not present a problem, the mats 80 easily can be stacked flat upon one another. The dimensions of the mat 80 are not highly critical, however, the mats 80 generally are 260 to 460 mm wide and 500 to 700 mm long and on the order of 3 to 5 mm thick. One convenience size for the mat 80 is about 360 mm wide, 600 mm long and 3.4 mm thick.

Referring to FIG. 9, the mat 80 has an elongated body portion 82 The mat portion 82 preferably is formed in a generally rectangular shape from a plastic material such as polyethylene, with a fairly smooth surface 84 for ease of sliding and positioning of the mats 80 under a patient. The second side of the mat (FIG. 10) preferably has a textured surface 86 like the surface 72 (FIG. 8).

The ends of the mat 80 include the respective openings 22, 24 which can be grasped by an attendant to lift or move the patient. Second smaller openings or slots 26, 28 are included adjacent respective openings 22, 24, which slots 26, 28 and openings 22, 24 accommodate the strap 30 therethrough. The strap 30 includes fastening means 32, 34 at each end thereof, such as a typical loop and hook type of fastener which has the loop area 36 and the hook area 38 which adhere to each other when pressed together.

Figure 10:
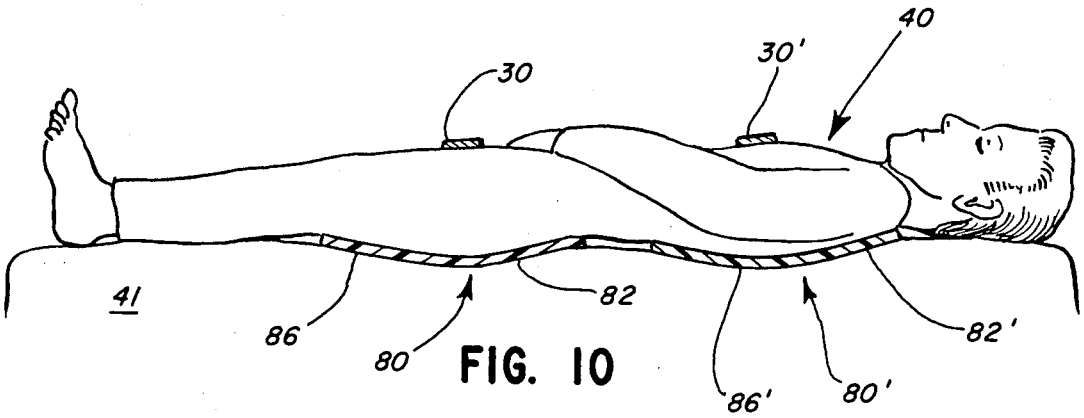
FIG. 10 is a side sectional view of mats of FIG. 9 and a patient thereon.

Referring now to FIG. 10, the method and system of shifting or moving of the patient 40 onto or out of the bed 41 by an attendant is best illustrated. A pair of mats 80 and 80′ is inserted under the patient 40 and then the straps 30, 30′ can be fastened over the patient 40 to secure the patient to the mats 80, 80′ while the patient is moved. If required, a second attendant (not illustrated in FIG. 3) can grasp the pair of mats 80, 80′ utilizing the openings 24 and 24′, while the attendant 42 grasps the openings 22, 22′. The small/relative surface area of the mats 80, 80′ allow them to be easily slid or placed under the patient 40, while still providing the necessary strength to lift the patient 40, if required.

As can be seen, the mat 80 is placed under the buttocks of the patient 40, while the mat 80′ is placed under the upper back of the patient. The body portion 82 and 82′ of the flexible mats 80 and 80′ at least partially conform with the contour of the patient's body, when the patient 40 is resting on a surface, such as the bed 41. The body portions 82 and 82′ provide a large and sufficient sliding surface for ease in moving the patient 40, while still allowing the mats 80 and 80′ to be small in size and weight for use in handling and storage. The mats 80, 80′ then provide a very easy to use patient moving method and system, while the mats can be stacked or hung for storage, such as on a convenient hook 44 (FIG. 1). The hook 44 or other protuberance can be on a gurney or transfer bed/stretcher or in any other convenient location.

Modifications and variations of the present invention are possible in light of the above teachings. The strap 30, of course, does not have to be, although preferably is, utilized with the mat 80. The strap 30 can be formed from any convenient material and can be eliminated if desired. It is, therefore, to be understood that within the scope of the appended claims the invention can be practiced otherwise than as specifically claimed.

What is claimed and desired to be secured by Letters Patent of the United States is:

1. A simplified patient transfer mat comprising:

an elongated body portion having a substantially elongated rectangular shape adapted to be placed transversely under a selected portion of the torso of a patient to facilitate moving at least said torso portion of the patient;

said body portion being formed from a flexible but substantially rigid lightweight material which will a least partially conform with the contour of a portion of the patient's body and provide a sufficient sliding surface for moving said patient, said body portion being integrally formed of a single planar piece of said material, said body portion having a length substantially less than the length of a patient, but greater than the width of a patient and a width substantially less than said length, said width being at least a third of said length; and openings in each of said body portion adapted to be grasped by an attendant to move said patient and each end having a width lesser than the body portion width with substantially straight edges extending from and joining said end to the body portion to assist in inserting said body portion beneath the torso portion of the patient by sliding under said torso portion.

2. The mat as defined in claim 1 wherein said ends of said body portions including said openings is formed from a thicker portion of material to provide enhanced strength thereto.

3. The mat as defined in claim 1 including a slot spaced inside and adjacent to each said opening and means for securing said patient to said mat adapted to be secured through said slots.

4. The mat as defined in claim 3 wherein said securing means is a strap having means to releaseably secure the ends of the strap to the strap spaced from said ends of the strap through said slots and openings to secure said patient to said mat.

5. The mat as defined in claim 1 including at least one side of said body portion being formed with a textured surface to reduce friction and static electricity.

6. A simplified patient transfer system, said system comprising:

a pair of transfer mats, each of said transfer mats including an elongated body portion having a substantially elongated rectangular shape adapted to be placed transversely under a selected portion of the torso of a patient to facilitate moving at least said torso portion of the patient;

said body portion being formed from a flexible but substantially rigid lightweight material which will at least partially conform with the contour of a portion of the patient's body and provide a sufficient sliding surface for moving the patient, and openings in each end of said body portion adapted to be grasped by an attendant to move the patient and each end having a width lesser than the body portion width with substantially straight edges extending from and joining said end to the body portion to assist in inserting said body portion beneath the torso portion of the patient by sliding under said torso portion each of said body portions being integrally formed of a single planar piece of said material, said body portion having a length substantially less than the length of a patient, but greater than the width of a patient and a width substantially less than said length, said width being at least a third of said length.

7. The system as defined in claim 6 wherein said ends of said body portions including said openings is formed from a thicker portion of material to provide enhanced strength thereto.

8. The system as defined in claim 6 including a slot spaced inside and adjacent to each said opening and means for securing said patient to said mat adapted to be secured through said slots.

9. The system as defined in claim 8 wherein said securing means is a strap having means to releaseably secure the ends of the strap to the strap spaced from said ends of the strap through said slots and openings to secure said patient to said mat.

10. The system as defined in claim 6 including at least one side of said body portion being formed with a textured surface to reduce friction and static electricity.

11. A method of transferring patients substantially from one contiguous surface to another, comprising:

providing a pair of transfer mats, each of said transfer mats including an elongated body portion having a substantially elongated rectangular shape adapted to be placed transversely under a patient to facilitate the moving of the patient, said body portion having a length substantially less than the length of a patient, but greater than the width of a patient and a width substantially less than said length, said body portion being integrally formed of a single planar piece of said material, said width being at least a third of said length;

placing said mats under the patient by sliding one of said mats transversely under the patient's buttocks and sliding the second one of said mats under the patient's shoulders, both without lifting or turning the patient over; and openings in each end of said body portion adapted to be grasped by an attendant to move the patient and transferring the patient by sliding the patient on the two mats from a first one of the contiguous surfaces to the other and each end having a width lesser than the body portion width with substantially straight edges extending from and joining said end to the body portion to assist in inserting said body portion beneath the patient.

12. The method as defined in claim 11 including providing means to at least partially conform with the contour of a portion of the patient's body and a sufficient sliding surface for moving the patient and conforming the mats by placing one mat substantially transverse of the buttocks and the other mat substantially traverse of the shoulder of the patient.

13. The method as defined in claim 12 including forming a slot spaced inside and adjacent to each said opening and means for securing the patient to said mat adapted to be secured through said slots and securing the patient to each of said mats prior to moving the patient.

14. The method as defined in claim 13 including forming said securing means as a strap having means to releaseably secure the ends of the strap to the strap spaced from said ends of the strap through said slots and opening to secure the patient to said mat and securing the patient to each of said mats by said straps prior to moving the patient.

* * * * *